US012490874B2

(12) United States Patent
Park et al.

(10) Patent No.: US 12,490,874 B2
(45) Date of Patent: Dec. 9, 2025

(54) VACUUM CLEANER

(71) Applicant: LG Electronics Inc., Seoul (KR)

(72) Inventors: Kihong Park, Seoul (KR); Jeongseop Park, Seoul (KR); Kahyung Choi, Seoul (KR); Yeonsub Jin, Seoul (KR)

(73) Assignee: LG Electronics Inc., Seoul (KR)

( * ) Notice: Subject to any disclaimer, the term of this patent is extended or adjusted under 35 U.S.C. 154(b) by 364 days.

(21) Appl. No.: 18/042,836

(22) PCT Filed: Nov. 12, 2020

(86) PCT No.: PCT/KR2020/015886
§ 371 (c)(1),
(2) Date: Feb. 24, 2023

(87) PCT Pub. No.: WO2022/065580
PCT Pub. Date: Mar. 31, 2022

(65) Prior Publication Data

US 2023/0292967 A1 Sep. 21, 2023

(30) Foreign Application Priority Data

Sep. 28, 2020 (KR) ..... 10-2020-0125958

(51) Int. Cl.
*A47L 9/04* (2006.01)
*A47L 9/28* (2006.01)

(52) U.S. Cl.
CPC ..... *A47L 9/0411* (2013.01); *A47L 9/2826* (2013.01); *A47L 9/2842* (2013.01); *A47L 9/2884* (2013.01)

(58) Field of Classification Search
CPC .... A47L 9/0411; A47L 9/2826; A47L 9/2842; A47L 9/2884
See application file for complete search history.

(56) References Cited

U.S. PATENT DOCUMENTS

2020/0288930 A1 9/2020 Wells
2021/0251451 A1* 8/2021 Ko ..... A47L 11/4011
2023/0054401 A1* 2/2023 Truitt ..... A47L 9/2831

FOREIGN PATENT DOCUMENTS

JP H05-317213 12/1993
JP H05317213 A * 12/1993
(Continued)

OTHER PUBLICATIONS

JP H05317213 A—English Machine Translation (Year: 1993).*
(Continued)

*Primary Examiner* — Marc Carlson
(74) *Attorney, Agent, or Firm* — Fish & Richardson P.C.

(57) ABSTRACT

Disclosed is a vacuum cleaner. The present disclosure includes a suction motor providing a suction force, a nozzle unit sucking dust on a floor surface, a nozzle motor transferring a drive force to a rotating part, a nozzle shutter adjusting a size of a dust inlet, a battery providing power, a model selecting unit generating information on an operating state corresponding to a drive mode of the suction motor and an open/closed state of the nozzle shutter, an artificial intelligence unit generating probability information through an artificial intelligence model using current information, voltage information and the information on the operating state, and a controller controlling the drive mode in response to the probability information.

18 Claims, 11 Drawing Sheets

(56) References Cited

FOREIGN PATENT DOCUMENTS

| | | | | |
|---|---|---|---|---|
| JP | 2001245834 | A | * | 9/2001 |
| JP | 2006-116058 | | | 5/2006 |
| JP | 2020-151010 | | | 9/2020 |
| JP | 2020151010 | A | * | 9/2020 |
| KR | 10-2020-0009680 | | | 1/2020 |

OTHER PUBLICATIONS

International Search Report and Written Opinion in International AppIn. No. PCT/KR2020/015886, mailed on Dec. 27, 2021, 19 pages (with English translation).

* cited by examiner (a)

(b)

(b)

(a)

VACUUM CLEANER

CROSS-REFERENCE TO RELATED APPLICATIONS

This application is a National Stage application under 35 U.S.C. § 371 of International Application No. PCT/KR2020/015886, filed on Nov. 12, 2020, which claims the benefit of Korean Application No. 10-2020-0125958, filed on Sep. 28, 2020. The disclosures of the prior applications are incorporated by reference in their entirety.

TECHNICAL FIELD

The present disclosure relates to a vacuum cleaner, and more particularly, to a vacuum cleaner suitable for calculating probability of a type of a currently cleaned floor using Artificial Intelligence (AI) technology and varying a suction force of the cleaner automatically depending on a situation.

BACKGROUND ART

A vacuum cleaner is a device for doing the cleaning by sucking dust or particles in a cleaning target area. Such cleaners may be classified into a manual cleaner for doing the cleaning in a manner that a user moves the cleaner in direct and an automatic cleaner for doing the cleaning in a manner of travelling by itself.

Manual cleaners may be classified into a canister type, an upright type, a handy type, a stick type and the like depending on cleaner styles.

A cleaner may clean a floor surface suing a nozzle. Generally, a nozzle is usable to suck air and dust. In addition, depending on the type of nozzle, a mop is attached to the nozzle, whereby a floor can be cleaned with the mop.

According to a related art, when the material of a floor changes in the course of cleaning the floor with a cleaner, a user may recognize or determine the change. If so, the user may apply an input for changing an output of the cleaner during the cleaning work. A controller receives the input for changing the output of the cleaner from the user and then varies an output of a suction motor in general.

In addition, recently developed Vacuum cleaners include a sensing unit capable of detecting a change of a floor material. If the sensing unit detects that the floor material has changed during the cleaning, a controller receives the detected change and may provide a function of varying a suction force automatically.

Generally, a vacuum cleaner determines a type of a floor with reference to a current flowing through a nozzle motor attached to a head and then varies a suction force. Particularly, Korean Patent No. 10-1411742 discloses a robot cleaner configured to vary a suction force depending on a floor detection result. The variation of the suction force is set to be changed depending on whether a current load measured at a nozzle part exceeds a threshold.

However, in case of predicting a type of a floor surface according to a single threshold like the related art, it may lead to unintended results due to a user's cleaning pattern change, a collision with an obstacle, and the like, thereby causing a problem of malfunction of a device.

DISCLOSURE

Technical Task

One technical task of the present disclosure is to provide a vacuum cleaner capable of sensing a floor surface by applying a probability modeling scheme based on one or more composite data. Particularly, a vacuum cleaner according to embodiments may include an Artificial Intelligence (AI) unit capable of providing highly reliable sensing performance in various situations using an AI model configured using machine learning.

Technical Solution

To achieve these objects and other advantages and in accordance with the purpose of the disclosure, as embodied and broadly described herein, a vacuum cleaner according to one embodiment of the present disclosure may include a suction motor providing a suction force, a nozzle unit having a rotating part and a dust inlet so as to suck dust on a floor surface by receiving the suction force from the suction motor, a nozzle motor provided to the nozzle unit to transfer a drive force to the rotating part, a nozzle shutter provided to the nozzle unit to adjust a size of the dust inlet, a battery providing power to the suction motor, the nozzle motor and the nozzle shutter, a model selecting unit generating information on an operating state corresponding to a drive mode of the suction motor and an open/closed state of the nozzle shutter, an artificial intelligence unit generating probability information through an artificial intelligence model using at least one of current information on a current value flowing through the nozzle motor, voltage information on a voltage value of the battery, and the information on the operating state, and a controller controlling the drive mode in response to the probability information.

Preferably, the probability information may include a first probability value indicating that the floor surface is a first type and a second probability value indicating that the floor surface is a second type.

More preferably, the drive mode may include a first mode and a second mode and the suction motor may have a higher suction force in the first mode rather than the second mode. If the first probability value is greater than the second probability value, the controller may drive the suction motor in the first mode. If the first probability value is not greater than the second probability value, the controller may drive the suction motor in the second mode.

In this case, the operating state may include one of a first state that the suction motor operates in the first mode while the nozzle shutter is in the open state, a second state that the suction motor operates in the second mode while the nozzle shutter is in the open state, and a third state that the suction motor operates in the first mode while the nozzle shutter is in the closed state. The artificial intelligence model may include information obtained through machine learning to determine the first probability value and the second probability value in response to the first to third states. The artificial intelligence unit may obtain the first probability value and the second probability value in one of the first to third states using the artificial intelligence model.

The artificial intelligence model may include a first model machine-learned in the first state, a second model machine-learned in the second state, and a third model machine-learned in the third state. The artificial intelligence unit may obtain the first probability value and the second probability value in a manner of using the first model when the operating state is the first state, using the second model when the operating state is the second state, and using the third model when the operating state is the third state.

More preferably, the artificial intelligence model may include a learning model for the first probability value and the second probability value corresponding to a combination of the voltage information and the current information. The artificial intelligence unit may generate the first probability value and the second probability value corresponding to the current information and the voltage information through the learning model.

Preferably, the vacuum cleaner may further include a pre-processing unit generating the current information by processing the current value flowing through the nozzle motor. The pre-processing unit may generate the current information by calculating an arithmetic mean of the current value measured with a configured time length and a configured time interval.

In another aspect of the disclosure, as embodied and broadly described herein, a method of controlling a vacuum cleaner according to one embodiment of the present disclosure may include a first step of generating information on an operating state by receiving a drive mode of a suction motor and an open/closed state of a nozzle shutter, a second step of generating current information by receiving a current value flowing through a nozzle motor, a third step of generating voltage information by receiving a voltage value of a battery, a fourth step of generating probability information through an artificial intelligence model using at least one of the operating state, the current information and the voltage information, and a fifth step of controlling the drive mode of the suction motor in response to the probability information.

Preferably, the probability information may include a first probability value indicating that a floor surface currently cleaned is a first type and a second probability value indicating that the floor surface is a second type.

More preferably, the drive mode may include a first mode and a second mode. The suction motor may have a higher suction force in the first mode rather than the second mode. If the first probability value is greater than the second probability value, the fifth step may drive the suction motor in the first mode. If the first probability value is not greater than the second probability value, the fifth step may drive the suction motor in the second mode.

In this case, the operating state may include one of a first state that the suction motor operates in the first mode while the nozzle shutter is in the open state, a second state that the suction motor operates in the second mode while the nozzle shutter is in the open state, and a third state that the suction motor operates in the first mode while the nozzle shutter is in the closed state. The artificial intelligence model may include information obtained through machine learning to determine the first probability value and the second probability value in response to the first to third states. The fourth step may obtain the first probability value and the second probability value in one of the first to third states using the artificial intelligence model.

The artificial intelligence model may include a first model machine-learned in the first state, a second model machine-learned in the second state, and a third model machine-learned in the third state. The fourth step may obtain the first probability value and the second probability value in a manner of using the first model when the operating state is the first state, using the second model when the operating state is the second state, and using the third model when the operating state is the third state.

More preferably, the artificial intelligence model may include a learning model including the first probability value and the second probability value corresponding to a combination of the voltage information and the current information. The fourth step may generate the probability information by finding the first probability value and the second probability value corresponding to the current information and the voltage information from the learning model.

Preferably, the second step may generate the current information by calculating an arithmetic mean of the current value measured with a configured time length and a configured time interval.

It is to be understood that both the foregoing general description and the following detailed description are exemplary and explanatory and are intended to provide further explanation of the disclosure as claimed.

Advantageous Effects

Firstly, an AI unit included in a vacuum cleaner according to the present disclosure may generate probability information indicating a prescribed type of a floor surface currently cleaned by a user. A controller receives the probability information on the floor surface type from the AI unit, thereby controlling a drive mode of the vacuum cleaner.

Particularly, the AI unit may predict a type of a currently cleaned floor surface using a conventionally machine-learned neural network model. The AI unit may predict a type of a currently cleaned floor surface using one or more informations such as a value of a current flowing through a nozzle motor, a voltage value of a battery, an open/closed state of a nozzle shutter, and a drive mode of a suction motor. This increases a probability of predicting a floor surface type more accurately than a related art of using a current flowing through a nozzle motor only.

BEST MODE

Mode for Disclosure

Figure 1:
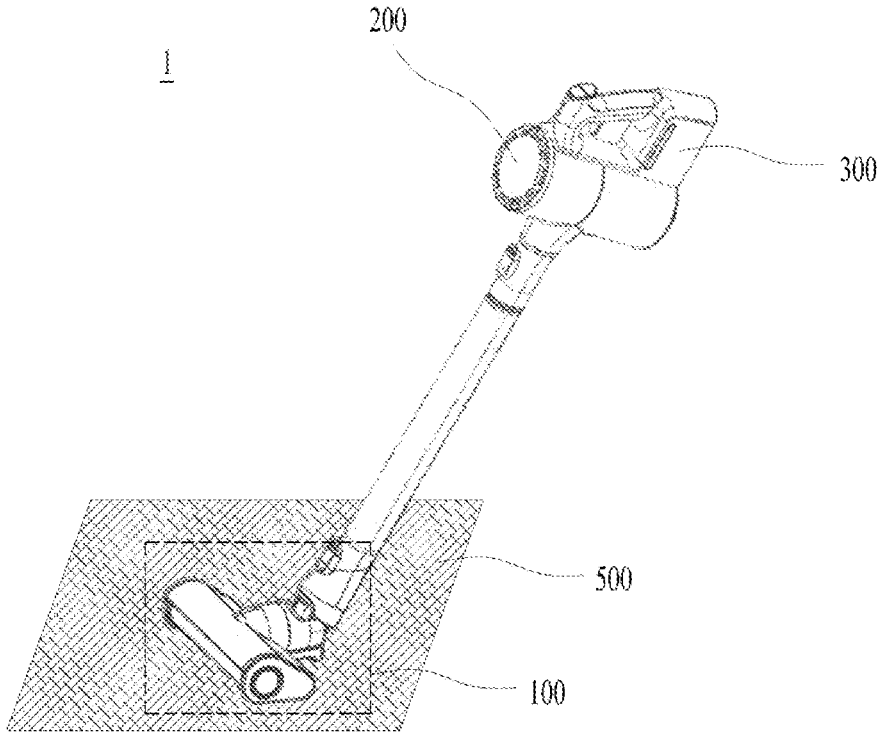
FIG. 1 is a perspective diagram showing a state that a vacuum cleaner according to embodiments of the present disclosure is cleaning a floor surface.

Reference will now be made in detail to the preferred embodiments of the present disclosure, examples of which are illustrated in the accompanying drawings, to facilitate those having ordinary skill in the art to implement the disclosure.

In this process, the size, shape, etc. of the components illustrated in the drawings may be exaggerated for clarity and convenience of description. In addition, the terms specifically defined in consideration of the configuration and action of the present disclosure may vary according to the intentions or practices of users and operators.

Terms including an ordinal number such as 'first', 'and/or', 'second', etc. may be used to describe various components, not limiting the components. The terms are used only for the purpose of distinguishing one component from another component. For example, within the scope of rights under the concept of the present disclosure, a first component may be named a second component, and similarly the second component may also be named the first component.

These terms shall be defined and understood based on the content throughout the present specification.

A basic structure of a vacuum cleaner 1 included in embodiments will be described with reference to FIG. 1 and FIG. 2 as follows.

FIG. 1 is a diagram showing a state that a vacuum cleaner 1 according to embodiments of the present disclosure is sucking dust located on a floor surface 500.

Referring to FIG. 1, in case of using a vacuum cleaner 1 of a handstick type, a user generally cleans the floor surface 500 in a manner of moving an indoor and/or outdoor space while holding a handle. A battery 300 supplying power is installed in a handle part located at one end of the vacuum cleaner 1. A suction motor 200 receives power from the battery 300, thereby generating a suction force. A nozzle unit 100 located at the other end of the vacuum cleaner 1 is connected to the suction motor 200 through a communicating part. The nozzle unit 100 may suck dust and/or particles located on the floor surface 500 based on the suction force generated by the suction motor 200.

Figure 2:
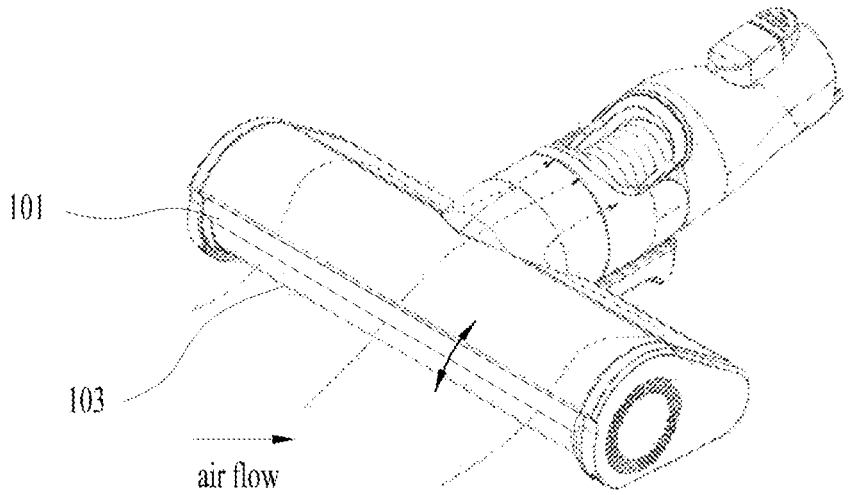
FIG. 2 is a diagram showing perspective and exploded views of a nozzle unit of a vacuum cleaner according to embodiments of the present disclosure.
Figure 2:
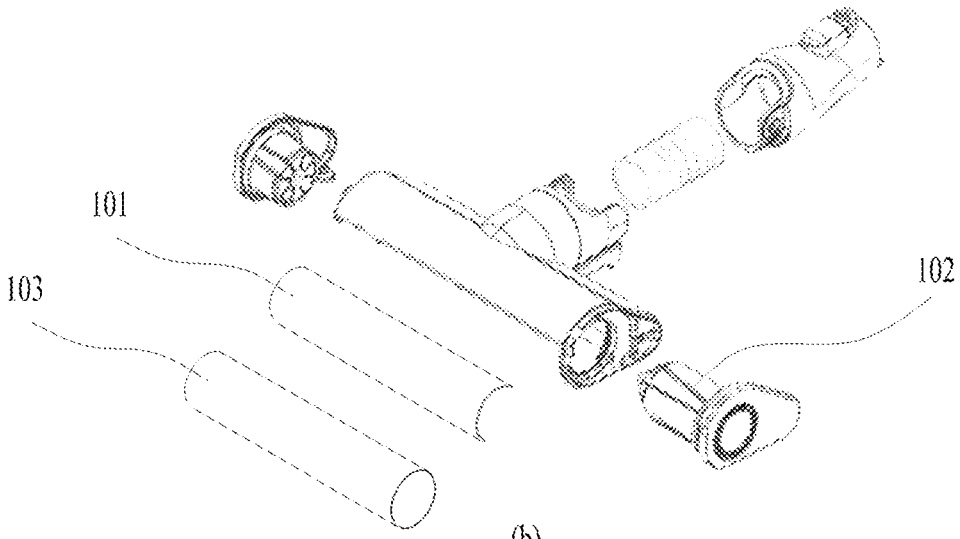

FIG. 2(*a*) is a diagram showing a basic structure of the nozzle unit 100 included in the vacuum cleaner 1, and FIG. 2(*b*) is an exploded diagram showing the parts configuring the nozzle unit 100.

Referring to FIG. 2, a dust inlet (not shown) for sucking dust and/or particles on a floor surface may exist on one side of the nozzle unit 100. The nozzle unit 100 may include a rotating part 103 configured with a brush and the lie to move the dust on the floor surface to the dust inlet (not shown). In addition, the nozzle unit 100 may include a nozzle motor 102 delivering a drive force to the rotating part 103 by receiving power from the battery 300 and a nozzle shutter 101 adjusting a size of the dust inlet (not shown) by receiving power from the battery 300.

The nozzle shutter 101 may stay in an open or closed state. When the nozzle shutter 101 is in the open state, since a size of the dust inlet (not shown) is increased, particles in relatively large size may be sucked in. When the nozzle shutter 101 is in the closed state, since a size of the dust inlet (not shown) is decreased, it brings an effect that a suction force of the vacuum cleaner 1 is increased.

Once the nozzle shutter 101 enters the open state, as a size of the dust inlet is increased, a suction force is decreased. In doing so, an adhesive force between the nozzle unit 100 and the floor is weakened owing to the decreased suction force. In this case, since the rotating part 103 is facilitated to move over the floor surface relatively, an amount of a current flowing through the nozzle motor 102 is reduced.

On the other hand, once the nozzle shutter 101 enters the closed state, as a size of the dust inlet is decreased, a suction force is increased. In doing so, an adhesive force between the nozzle unit 100 and the floor is strengthened owing to the increased suction force. In this case, in order to facilitate the rotating part 103 to move over the floor surface, an amount of a current flowing through the nozzle motor 102 is raised.

When a user does the cleaning of a floor surface using the vacuum cleaner 1, the floor surface may be assumed as having two kinds of types. In case of a hard type floor such as a paper floor, a wooden floor or the like, since dust and the like are exposed on a floor surface as they are, effective cleaning is available with a low suction force. Yet, in case of a carpet type floor such as Wilton, plush or the like, since dust is hidden in a floor surface, the cleaning needs to be done with a high suction force.

Assume a case that a user moves into an area of a carpet type floor in the course of cleaning a hard floor. According to the related art, when a user detects a change of a floor material, the vacuum cleaner 1 of an early type stops a cleaning operation of the vacuum cleaner 1 according to user's determination and provides a function of varying a suction force in response to a user's input of a button provided to the cleaner.

According to the related art, the vacuum cleaner 1 equipped with a function of varying a suction force automatically provides a function of varying the suction power in a manner that the sensing unit of the vacuum cleaner 1 self-determines a change of a floor material.

According to the related art of varying a suction force in a manner that a cleaner automatically determines a floor type, as the rotating part 103 receives a different rotation resistance depending on a different floor surface type, an amount of the current flowing through the nozzle motor 102 is changed.

According to the related arts, a vacuum cleaner is controlled on the assumption that a range of a current value flowing through the nozzle motor 102 differs depending on a type of a currently cleaned floor surface. Therefore, if the current flowing through the nozzle motor 102 exceeds a threshold, it is determined that a floor of a carpet type is being cleaned. If the current flowing through the nozzle motor 102 does not exceed the threshold, it is determined that a floor of a hard type is being cleaned. Yet, there are various limits and defects in the scheme of classifying a type of a currently cleaned floor surface using a current flowing through the nozzle motor 102.

The vacuum cleaner 1 according to the embodiments may include a suction motor 200 providing a suction force, a nozzle unit 100 sucking dust from a floor surface by receiving the suction force from the suction motor 200, a nozzle motor 102 provided to the nozzle unit 100 to transfer a drive force to a rotating part 103, and a nozzle shutter 101 provided to the nozzle unit 100 to adjust a size of a dust inlet. In addition, the vacuum cleaner 1 may include a battery 300 providing power to the suction motor 200, the nozzle motor 102 and the nozzle shutter 101.

The vacuum cleaner 1 according to the embodiments may include a model selecting unit S101 generating information on an operating state corresponding to a drive mode W of the suction motor 200 and an open/closed state O of the nozzle shutter 101 and an Artificial Intelligence (AI) unit S103 generating probability information on a type of a currently cleaned floor surface through an AI model. The AI model may generate probability information using current information A on a current value flowing through the nozzle motor 102, voltage information V on a voltage value of the battery 300, and information on an operating state of the vacuum cleaner 1.

A controller S104 included in the vacuum cleaner 1 may control the drive mode W of the suction motor 200 in response to the probability information generated from the AI unit S103.

Namely, the vacuum cleaner 1 according to the embodiments may use at least one of the information on the operating state, the current information A and the voltage information V in obtaining the type of the currently cleaned floor surface. This may have floor surface type prediction performance higher than that of the related art that uses the current information A only.

The probability information according to the embodiments may include a first probability value PC of a probability that the currently cleaned floor surface is a first type and a second probability value PH of a probability that the currently cleaned floor surface is a second type. In this case, the floor surface of the first type may include a floor surface of a carpet type that should be cleaned with a relatively higher suction force, and the floor surface of the second type may include a floor surface of a hard type that should be cleaned with a relatively lower suction force.

The drive mode W according to the embodiments may include a first mode M1 and a second mode M2. The suction motor 200 may have a higher suction force in the first mode M1 rather than the second mode M2. If the first probability value PC is greater than the second probability value PH, the controller S104 may drive the suction motor 200 in the first mode M1. If the first probability value PC is not greater than the second probability value PH, the controller S104 may drive the suction motor 200 in the second mode M2.

Particularly, if it is determined that the probability that the currently cleaned floor surface is the carpet type is higher than the probability that the currently cleaned floor surface is the hard type, the controller S104 may drive the suction motor 200 in the first mode M1. If it is determined that the probability that the currently cleaned floor surface is the hard type is higher than the probability that the currently cleaned floor surface is the carpet, the controller S104 may drive the suction motor 200 in the second mode M2.

The operating state of the vacuum cleaner 1 according to the embodiments may include a first state that the suction motor 200 is operating in the first mode M1 while the nozzle shutter 101 is in the open state, a second state that the suction motor 200 is operating in the second mode M2 while the nozzle shutter 101 is in the open state, or a third state that the suction motor 200 is operating in the first mode M1 while the nozzle shutter 101 is in the closed state.

The AI model according to the embodiments may include information, which may be obtained by a machine learning method, for determining the first probability value PC and the second probability value PH in response to the first to third states. The AI unit S103 may obtain the first probability value PC and the second probability value PH in one of the first to third states using the AI model.

The logic for a method of controlling the vacuum cleaner 1 according to the embodiments is described with reference to FIGS. 3 to 5 as follows.

Figure 3:
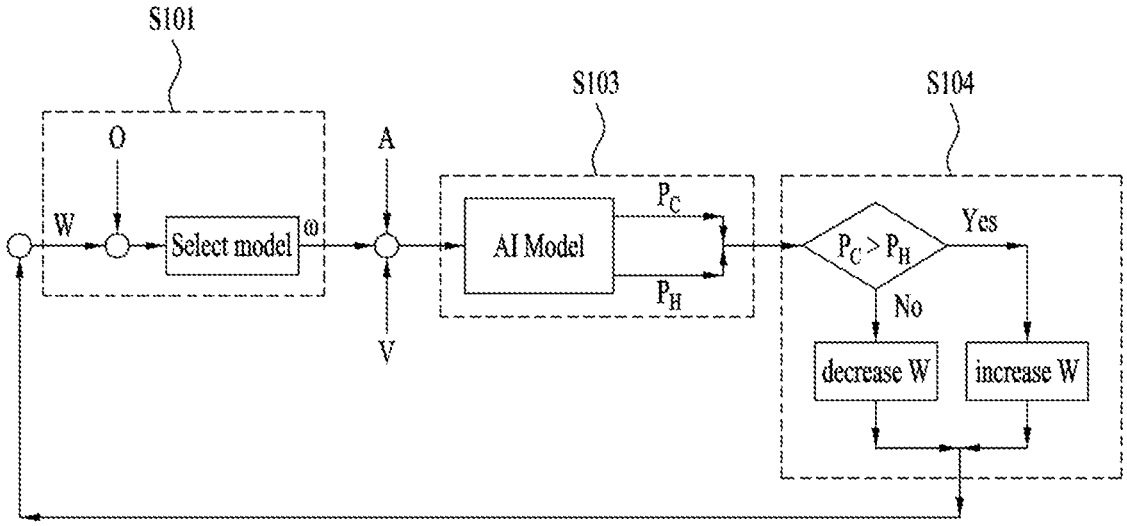
FIG. 3 is a flowchart showing a method of controlling a drive mode of a vacuum cleaner according to embodiments of the present disclosure.

FIG. 3 is a flowchart showing a basic method of controlling the vacuum cleaner 1 according to embodiments.

Referring to FIG. 3, the model selecting unit S101 of the vacuum cleaner 1 according to the embodiments may generate information on an operating state by receiving a drive mode W of the suction motor 200 and an open/closed state O of the nozzle shutter. The AI unit S103 may receive an operating state, current information A and voltage information V and generate a first probability value PC and a second probability value PH using the AI model. The controller S104 receives the first probability value PC and the second probability value PH. If the first probability value PC is higher than the second probability value PH, the controller S104 may increase an output of the suction motor 200. If the first probability value PC is not higher than the second probability value PH, the controller S104 may decrease an output of the suction motor 200. As the above process continues to be fed back, the drive mode W of the vacuum cleaner 1 may be controlled.

The controller S104 of the vacuum cleaner 1 according to the embodiments may use the relative comparison between estimated probability values per type instead of determining a type of a floor surface with the absolute sizes of the first probability value PC and the second probability value PH like the related art. Through this, it is possible to implement a composite determining method capable of including floor surfaces of various types.

For example, although both of the first probability value PC and the second probability value PH are low, it is able to determine a type of a floor surface by selecting a greater one of the first probability value PC and the second probability value PH.

If the first probability value PC is higher than the second probability value PH, the controller S104 according to the embodiments may increase the output of the suction motor 200 or drive the suction motor 200 in the first mode M1. In doing so, a model parameter used by the controller S104 in a next period may be the first or third state. If the first probability value PC is not higher than the second probability value PH, the controller S104 may decrease the output of the suction motor 200 or drive the suction motor 200 in the second mode M2. In doing so, a model parameter used by the controller S104 in a next period may be the second state.

Figure 4:
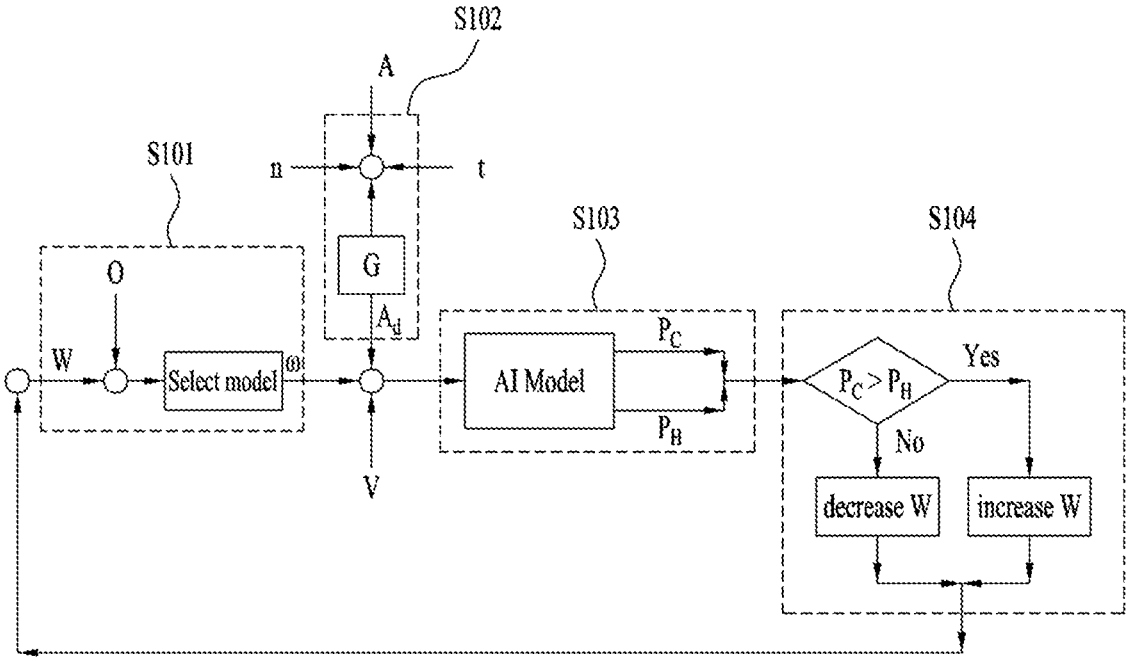
FIG. 4 is a flowchart showing a method of controlling a drive mode of a vacuum cleaner including a pre-processing unit.

FIG. 4 is a flowchart showing a method of controlling the vacuum cleaner 1 including the pre-processing unit S102 according to embodiments.

Referring to FIG. 4, a method of controlling the vacuum cleaner 1 according to embodiments may include a method of including the pre-processing unit S102 in addition to the former control method shown in FIG. 3. The pre-processing unit S102 may generate current information Ad pre-processed by processing a current value flowing through the nozzle motor 102. Particularly, the pre-processing unit S102 may generate the current information Ad pre-processed by calculating an arithmetic mean of a current value of the nozzle motor 102 measured with a configured time length t and a configured time interval n and forward the generated information to the AI unit S103.

Figure 5:
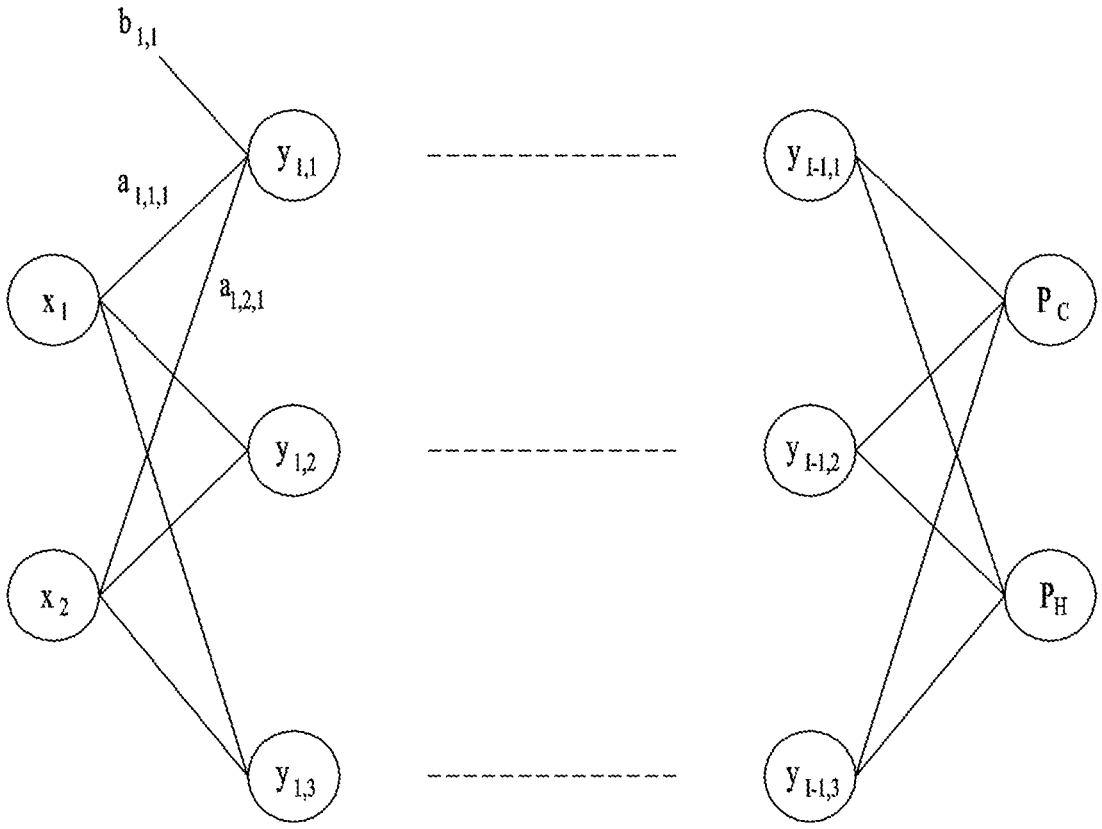
FIG. 5 is a conceptual diagram showing a synthetic neural network as one of machine learning schemes.

FIG. 5 shows a method of obtaining a first probability value PC and a second probability value PH through an AI model according to embodiments. In order to obtain the AI model, machine learning schemes such as Convolution Neural Network (CNN), Multi-Layer Perception (MLP), etc.

A method of obtaining probability information using MLP according to embodiments is described as follows. An AI model may receive an input of pre-processed current information Ad and an input of pre-processed voltage information V, respectively. In this case, by operating $\omega=\{a_{1,1,1}, a_{1,2,1}, b_{1,1}, \ldots, a_{l,m,n}, b_{l,n}\}$, which is a parameter for an operating state information, it is able to obtain an intermediate result value $Y=\{y_{1,1}, y_{1,2}, \ldots, y_{l,n}\}$. By repeating the above process, it is able to obtain $P=\{y_{1,1}, y_{1,2}, \ldots, y_{l,n}\}=\{P_C, P_H\}$ that is a result value of a final layer l. An operation expression used to obtain the result value may include $$y_{1,1}=a_{1,1,1}\times x_1+a_{1,2,1}\times x_2+b_{1,1}.$$

The AI model may be learned by cleaning floor surfaces of different types for the different operating states. Hence, it is unnecessary to perform modeling manually. And, the AI model can be derived by being optimized for the corresponding situation data. This may facilitate high-dimensional modeling. Since the AI model according to embodiments uses high-dimensional modeling, complexity of the model may increase. And, it is possible to finely analyze the complicated casualty among composite input data items.

The AI model according to the embodiments may be designed as a high-dimensional model that can cope with various situations in comparison to the conventional single threshold determining method. In addition, it is possible to determine a type of a floor surface with accuracy higher than the related art.

Problems of a method of obtaining a floor surface type using current information A only according to the related art are described with reference to FIGS. 6 to 8 as follows.

Figure 6:
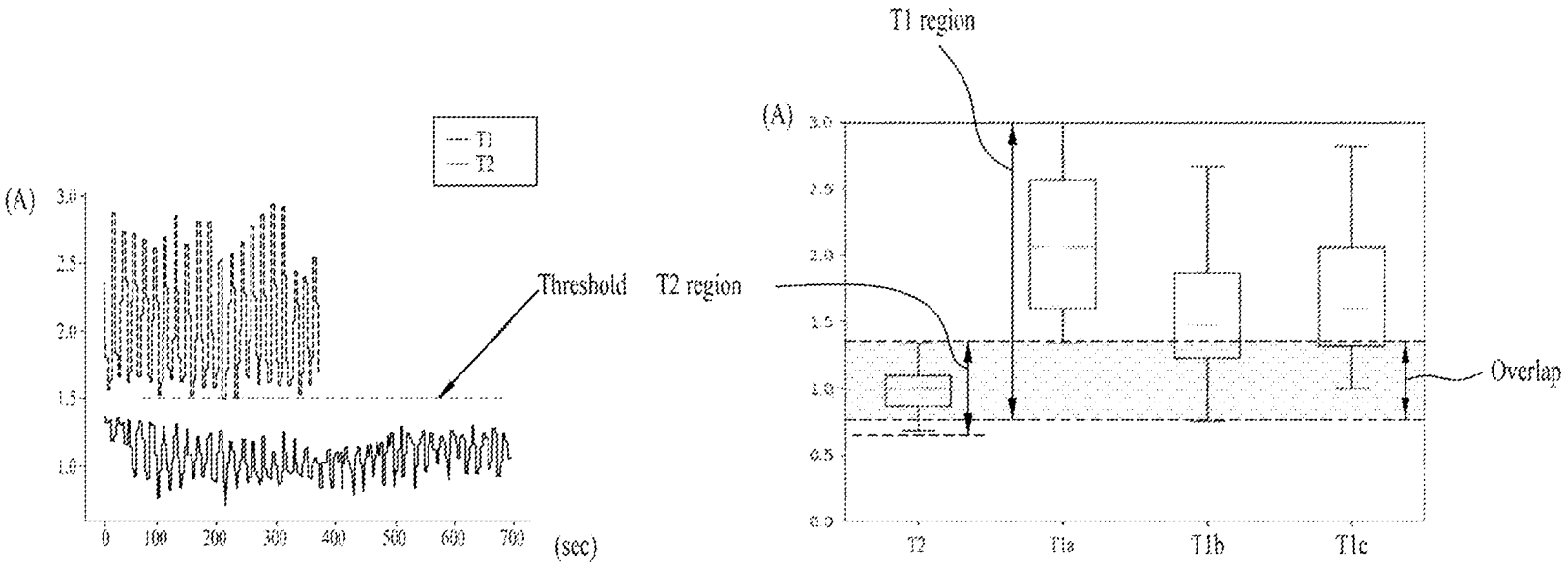
FIG. 6 is a diagram showing a situation that a vacuum cleaner according to embodiments of the present disclosure determines a floor surface type using current information only.

FIG. 6 is a diagram to describe problems caused in obtaining a floor surface type using the current information A only according to the related art when different first type floor surfaces exist.

FIG. 6(*a*) is a graph showing the time-current relation in generally identifying a floor surface according to a related art. If the current flowing through the nozzle motor 102 continues to exist in a range of exceeding a threshold, the controller S104 of the vacuum cleaner 1 may determine that a type of a currently cleaned floor surface is a first type. If the current flowing through the nozzle motor 102 continues to exist in a range of not exceeding the threshold, the controller S104 of the vacuum cleaner 1 may determine that a type of a currently cleaned floor surface is a second type.

The first type floor surface may include one of various types such as Wilton, plush, rug and the like. In addition, the first type floor surface may include a floor surface of a first case T1*a*, a second case T1*b* and/or a third case T1*c*, which have different features.

Referring to FIG. 6(*b*), when first type floor surfaces of different types exist, an overlapping range Overlap between a current range (T1 region) of a first type floor surface and a current range (T2 region) of a second type floor surface is considerably generated according to conditions such as a circuit configuration, a suction force, etc. of the vacuum cleaner 1. In this case, it is problematic that setting a threshold for floor surface type determination is not facilitated by the method of the related art.

Figure 7:
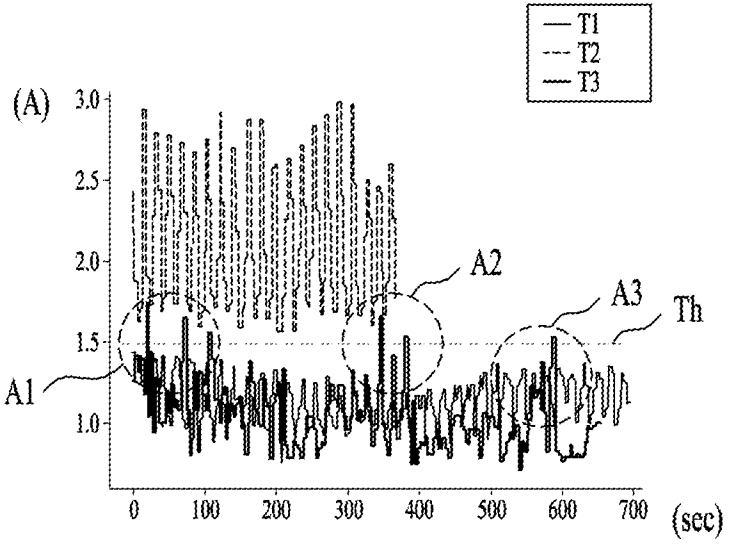
FIG. 7 is a diagram showing various problematic situations a vacuum cleaner according to embodiments of the present disclosure may experience in determining a floor surface type.
Figure 7:
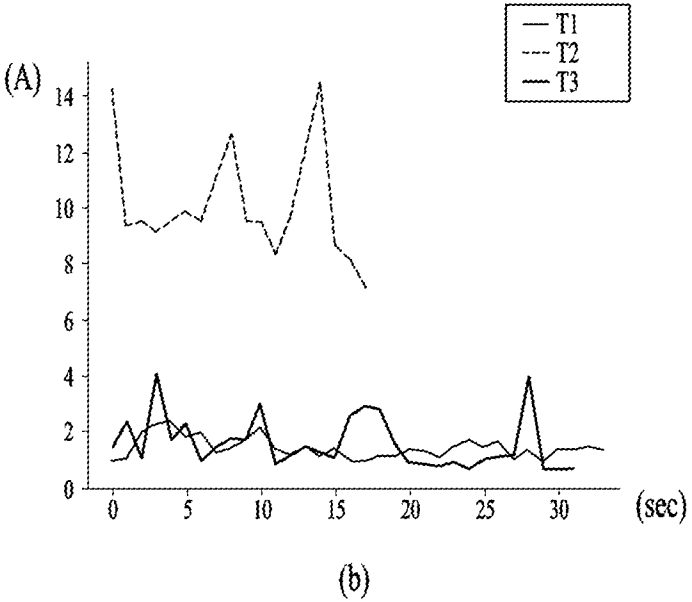

FIG. 7 is a diagram to describe a case that a second type floor surface is possibly misjudged as a first type floor surface in determining a floor surface type using the current information A only according to the related art and also describe the advantages of the vacuum cleaner 1 including the pre-processing unit S102.

FIG. 7(*a*) shows a current value T3 in case of possibly causing a determination error as well as a current value T1 on a first type floor surface and a current value T2 on a second type floor surface. The case of possibly causing the determination error may include a case that an uneven surface or particle exists on a floor surface during the cleaning, a case of turning a direction during the cleaning, a case that the nozzle unit 100 is bumped into an obstacle, etc.

Particularly, if an uneven surface exists on a floor surface or a tape, a drink, a sticky thing or the like exists on the floor surface, a frictional force between the nozzle unit 100 and the floor surface may increase. In case of turning a direction or stroking in a curved line during the cleaning, a force misaligned with a rotation direction of the rotating part 103 is generated, whereby a frictional force may increase. In case that the vacuum cleaner 1 is bumped into an obstacle, as the rotation of the rotating part 103 is interrupted, a frictional force may increase. Once the frictional force increases, a current flowing through the nozzle motor 102 increases. Hence, it may raise the possibility that a currently cleaned floor surface is misjudged as a first type floor surface.

Looking into the current value T3 in case of possibly causing the determination error with reference to FIG. 7(*a*), the current value instantly increases in the above-listed situations A1, A2 and A3, thereby exceeding the threshold. According to the related art, in the above situation, it may be misjudged that the first type floor surface is being cleaned despite that the second type floor surface is being cleaned actually.

FIG. 7(*b*) shows an embodiment of the vacuum cleaner 1 including the pre-processing unit S102. Through this, it is able to confirm an advantage of one of the embodiments of the present disclosure, i.e., a function of removing the possibility of misjudgment caused by current values exceeding a threshold.

Figure 8:
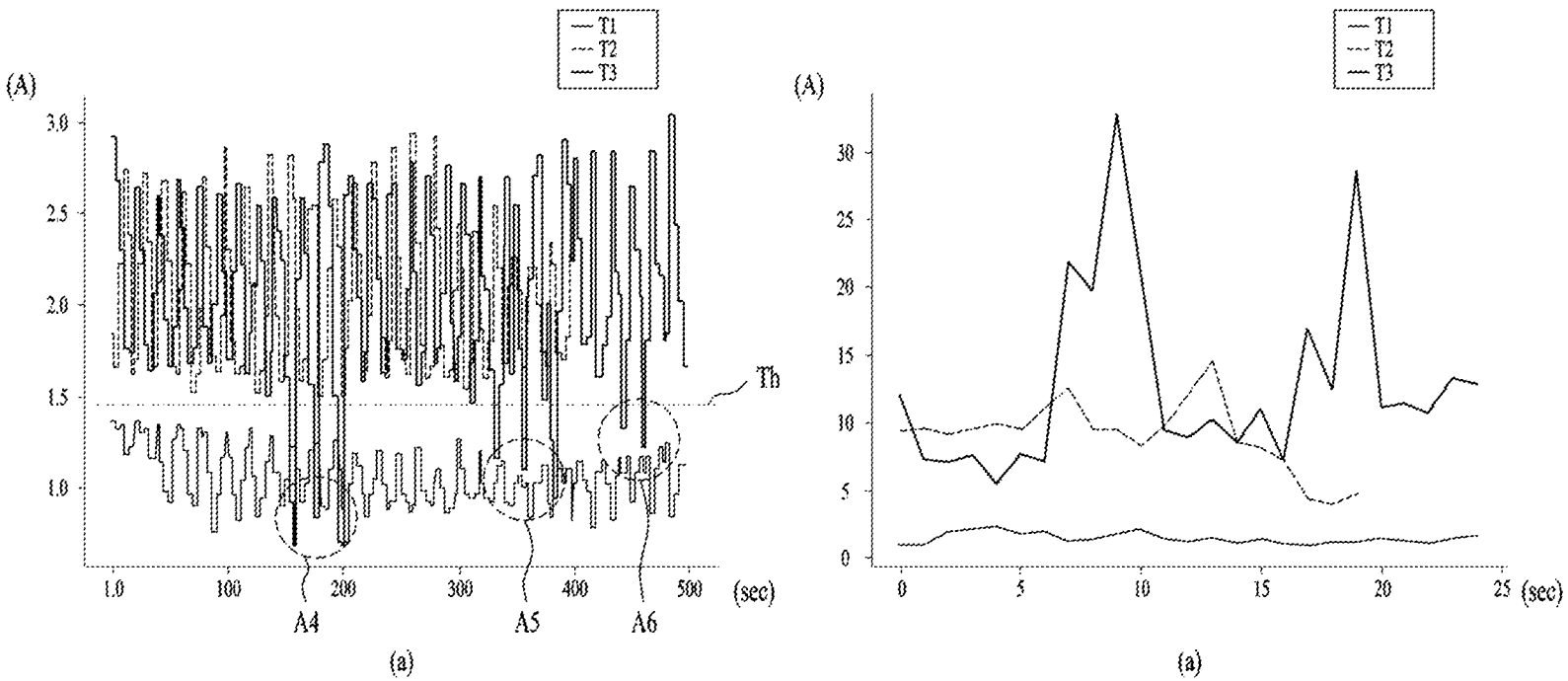
FIG. 8 is a diagram showing various problematic situations a vacuum cleaner according to embodiments of the present disclosure may experience in determining a floor surface type.

FIG. 8 is a diagram to describe a case that a first type floor surface is possibly misjudged as a second type floor surface in determining a floor surface type using the current information A only according to the related art and also describe the advantages of the vacuum cleaner 1 including the pre-processing unit S102.

FIG. 8(*a*) shows a current value T3 in case of possibly causing a determination error as well as a current value T1 on a first type floor surface and a current value T2 on a second type floor surface. The case of possibly causing the determination error may include a case that a load of the rotating part 103 is reduced by the nozzle unit 100 lifted in the air by a low object over/below the first type floor surface, a case that a load of the rotating part 103 is reduced by the nozzle unit 100 lifted in the air due to an uneven portion of the first type floor surface, a case that a load of the rotating part 103 is reduced by a rear part of the nozzle unit 100 lifted in the air due to a stroke during the cleaning, and the like.

Particularly, if an object such as a wire, a rod, a notebook or the like exists on a floor surface, the nozzle unit 100 may be lifted in the air. In addition, in case that a floor surface is a carpet or the like, as the carpet is overage or folded, a portion of the nozzle unit 100 may be lifted in the air. When a user pulls the vacuum cleaner 1 abruptly during the cleaning or the vacuum cleaner 1 is lifted during the cleaning by a tall user, a frictional force may decrease. If the frictional force decreases, the current flowing through the nozzle motor 102 is reduced, whereby the possibility of misjudging a currently cleaned floor surface as a second type floor surface is raised.

Regarding the current value T3 in case of possibly causing the determination error, the current value instantly decreases in the above-listed situations A4, A5 and A6, the current value T3 has a value below the threshold. According to the related art, in the above situation, it may be misjudged that the second type floor surface is being cleaned despite that the first type floor surface is being cleaned actually.

FIG. 8(*b*) shows an embodiment of the vacuum cleaner 1 including the pre-processing unit S102. Through this, it is able to confirm an advantage of one of the embodiments of the present disclosure, i.e., a function of removing the possibility of misjudgment caused by a current having a value below a threshold.

When the vacuum cleaner 1 including the pre-processing unit S102 according to embodiments determine a floor surface of a first type and a floor surface of a second type, which are different from each other, the advantages of the vacuum cleaner 1 are described with reference to FIG. 9.

Figure 9:
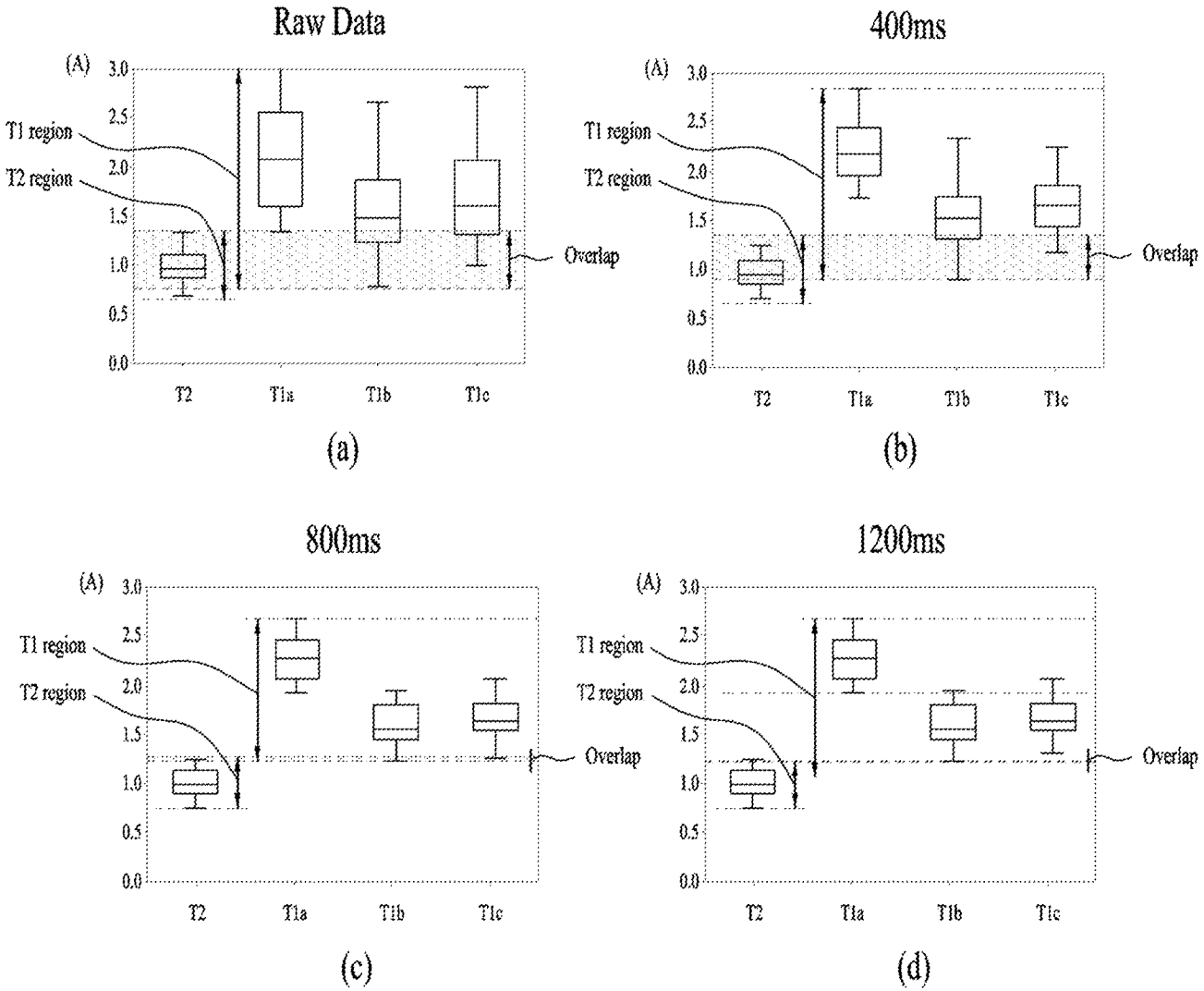
FIG. 9 is a diagram showing that a vacuum cleaner according to embodiments of the present disclosure determines a floor surface type using pre-processed current information.

Regarding the current value flowing through the nozzle motor 102, FIG. 9 shows a current range (T1 region) on a first type floor surface and a current range (T2 region) on a second type floor surface. FIG. 9(*a*) shows an unprocessed current value, FIG. 9(*b*) shows a current value pre-processed into a time length of 400 ms, FIG. 9(*c*) shows a current value pre-processed into a time length of 800 ms, and FIG. 9(*d*) shows a current value pre-processed into a time length of 1200 ms.

The first type floor surface may include one of various types such as Wilton, plush, rug and the like. In addition, the first type floor surface may include a floor surface of a first case T1*a*, a second case T1*b* and/or a third case T1*c*, which have different features. With respect to the first type floor surface of different types, each current value range may be different. In this case, the range of the current value for the first type floor surface is increased and may have a portion overlapping with the range of the current value of the second floor surface type.

In case of determining a floor surface using an unprocessed current value, the current range (T1 region) on the first type floor surface and the current range (T2 region) on the second type floor surface are formed wide. As described above, this is the effect caused because a non-general current value is included in the current range. Yet, when an arithmetic mean is calculated by measuring a current flowing through the nozzle motor 102 with a given time length and a given time interval, an effect of the non-general current value can be minimized. In case of pre-processing a current value by setting a time length to 400 ms, an overlapping portion (Overlap) of a current range for the floor surfaces of both types is not reduced considerably in comparison with the data that is not pre-processed. Yet, in case of pre-processing a current value by setting a time length to 800 ms or 1200 ms, it is confirmed that an overlapping portion (Overlap) of a current range for the floor surfaces of both types is reduced considerably. If the overlapping portion (Overlap) between the current ranges is reduced, setting a threshold is facilitated and accuracy in determining a floor surface type can be raised.

The time length of 800 ms may correspond to a time in which a stroke of a cleaner is performed once in consideration of a user's cleaning pattern. For a pre-processing result having a time length greater than this time, data on a level similar to the pre-processing result having the time length of 800 ms may be obtained. A result from performing a pre-processing by accumulating data for the time length of 800 ms in consideration of a response speed and accuracy of algorithm can be utilized for the floor surface type determination.

Particularly, a pre-processing method of current information A may utilize a method of obtaining an arithmetic mean for a current value flowing through the nozzle motor 102. For example, if a configured time length is 800 ms and a time interval for measuring a current value is 40 ms, 20 cumulative current values may be obtained. The pre-processing unit S102 may provide an arithmetic mean of the 20 cumulative current values to the AI unit S103.

A method for the vacuum cleaner 1 according to the embodiments determines a floor surface using a current information A and a drive mode W as parameters is described with reference to FIG. 10 as follows.

Figure 10:
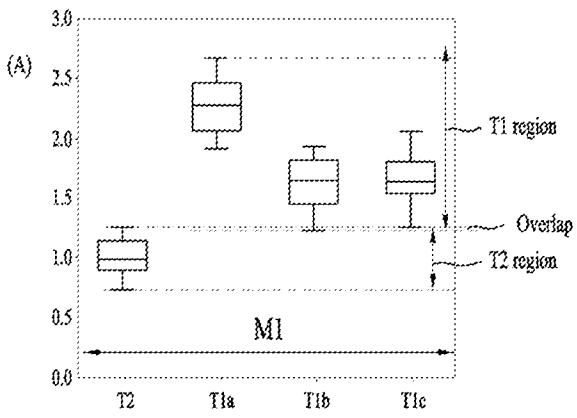
FIG. 10 is a diagram showing that a vacuum cleaner according to embodiments of the present disclosure determines a floor surface type using information on a drive mode and current information.
Figure 10:
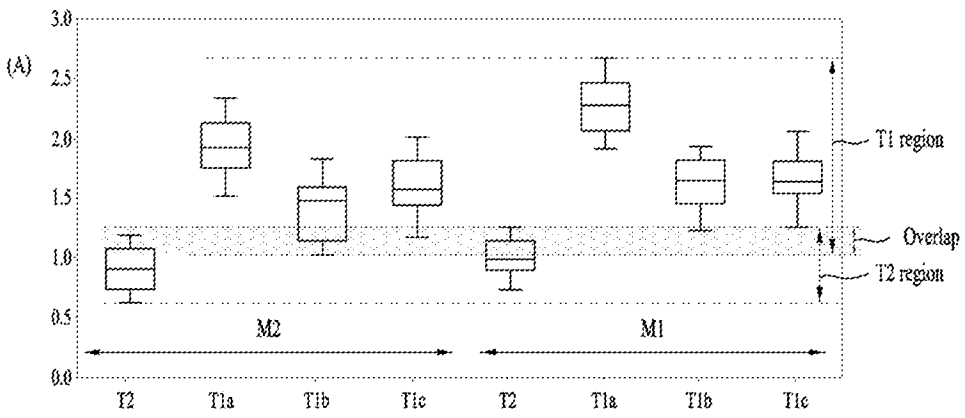

When a drive mode W of the suction motor 200 includes both a first mode M1 and a second mode M2, FIG. 10(*a*) is a diagram showing a current value flowing through the nozzle motor 102 according to each floor surface type. Here, a first type floor surface may include one of various types such as Wilton, plush, rug and the like. In addition, the first type floor surface may include a floor surface of a first case T1*a*, a second case T1*b* and/or a third case T1*c*, which have different features.

FIG. 10(*b*) is a diagram showing a current value flowing through the nozzle motor 102 according to each floor surface type when the drive mode W of the suction motor 200 is the first mode M1.

For the floor surface of the same type, current information A in the first mode M1 having a relatively high output of the suction motor 200 and current information A in the second mode M2 having a relatively low output may be different from each other. In this case, the current information A may be independently determined in the first mode M1 and the second mode M2.

Particularly, since the adhesion between the nozzle unit 100 and the floor surface is high in the first mode M1, the current value flowing through the nozzle motor 102 may have a relatively high size. On the other hand, since the adhesion between the nozzle unit 100 and the floor surface is low in the second mode M2, the current value flowing through the nozzle motor 102 may have a relatively low size.

In this case, when the floor surface of the second type is cleaned in the first mode M1, as a current value is increased relatively, an upper limit of the current range (T2 region) on the second type floor surface is raised. On the other hand, when the floor surface of the first type is cleaned in the second mode M1, as a current value is decreased relatively, a lower limit of the current range (T1 region) on the first type floor surface is lowered. Therefore, an overlapping portion (Overlap) between the current range values on the floor surfaces of the two types is increased.

FIG. 10(*b*) just shows the current value range in case that the drive mode W of the suction motor 200 is the first mode M1. Thus, in order to remove an overlapping portion (Overlap) between current ranges in different drive modes W, the vacuum cleaner 1 according to the embodiments may obtain current information A with reference to a specific drive mode W only. In addition, in order to remove an overlapping portion (Overlap) between current ranges for different outputs of the suction motor 200, the vacuum cleaner 1 according to the embodiments may obtain current information A with reference to a specific output value only. Through this, the overlapping portion between the respective current ranges may be minimized and setting a threshold for determining the first probability value PC and the second probability value PH is facilitated.

An embodiment of the vacuum cleaner generating probability information on each floor surface type using the combination of different voltage information V and different current information A is described with reference to FIG. 11 as follows. Here, a first type floor surface may include one of various types such as Wilton, plush, rug and the like. In addition, the first type floor surface may include a floor surface of a first case T1*a*, a second case T1*b* and/or a third case T1*c*, which have different features.

An AI model according to embodiments may include a learning model for a first probability value PC and a second probability value PH corresponding to the combination of voltage information V and current information A. The AI unit S103 may generate the first probability value PC and the second probability value PH corresponding to voltage information V and current information A through the learning model.

Particularly, when a floor is cleaned with the cleaner 1, the nozzle motor 102 operates to enable the rotating part 103 to rotate at a predetermined speed. The rotational speed of the rotating part 103 may be determined by the amount of power consumed by the nozzle motor 102. The amount of the consumed power may be expressed as a product of voltage and current. Therefore, in a motor rotating at the same rotational speed, the current flowing through the nozzle motor 102 at low voltage may have a value greater than the current flowing through the nozzle motor 102 at high voltage.

Particularly, after the vacuum cleaner 1 has been fully charged, the voltage of the battery 300 gradually decreases as a user proceeds with the cleaning process, and finally the battery 300 discharges.

On the other hand, the rotational speed of the rotating part 103 should be maintained constant during the cleaning process, so the current value flowing through the nozzle motor 102 increases relatively. Even if a floor surface of the same type is cleaned, the current value flowing through the nozzle motor 102 may vary depending on the capacity of the battery 300, which makes it difficult to determine a floor surface type.

Figure 11:
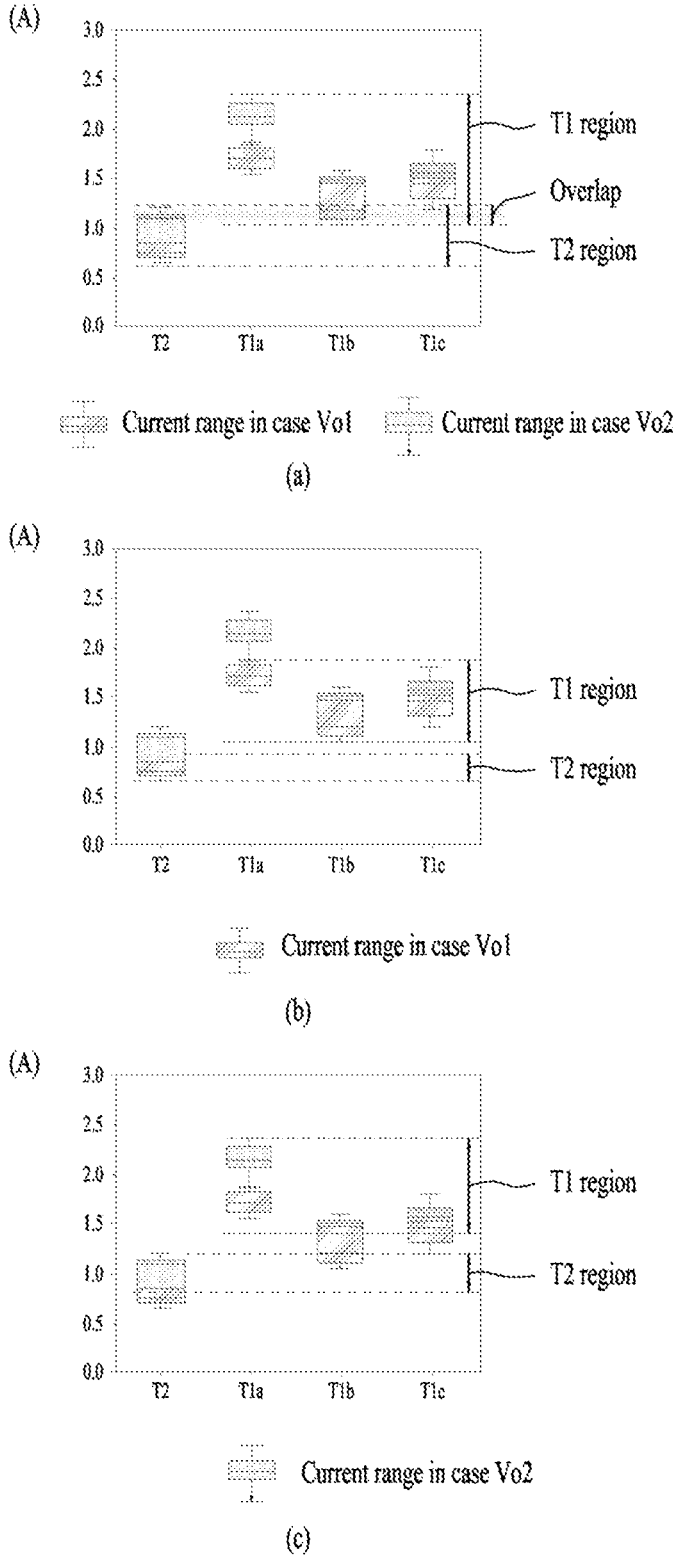
FIG. 11 is a diagram showing that a vacuum cleaner according to embodiments of the present disclosure determines a floor surface type using voltage information and current information.

FIG. 11(*a*) shows a method of obtaining a per-type current range of a floor surface irrespective of the voltage of the battery 300 according to a related art. A voltage provided to the vacuum cleaner 1 by the battery 300 may include a first voltage Vo1 or a second voltage Vo2. Here, the first voltage Vo1 may be higher than the second voltage Vo2. In the embodiment of FIG. 11(*a*), a current range of the first voltage Vo1 or the second voltage Vo2 is not discriminated and an overlapping portion (Overlap) between a current range (T1 region) on a first type floor surface and a current range (T2 region) on a second type floor surface is generated.

An embodiment of FIG. 11(*b*) shows a method of determining a floor surface type using a current range at the first voltage Vo1 only. An embodiment of FIG. 11(*c*) shows a method of determining a floor surface type using a current range at the second voltage Vo2 only. In this case, it is observed that an overlapping portion (Overlap) between a current range (T1 region) on a first type floor surface and a current range (T2 region) on a second type floor surface does not exist on the floor surfaces of both types. Hence, setting a threshold for determining a first probability value PC and a second probability value PH is facilitated.

The AI unit S103 and AI model of the vacuum cleaner 1, which generates probability information on each floor surface type in consideration of voltage information V together despite obtaining the same current value, according to an embodiment are described with reference to FIG. 12 as follows.

Figure 12:
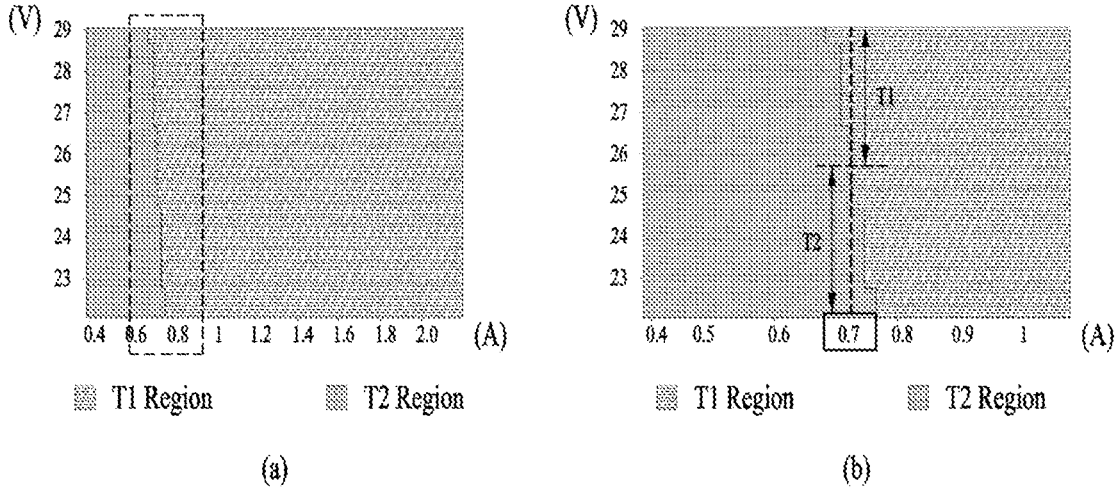
FIG. 12 is a diagram showing that a vacuum cleaner according to embodiments of the present disclosure determines a floor surface type using different voltage informations on a specific current value.

FIG. 12(*a*) is a graph showing that a determination result of a floor surface is differentiated according to a different voltage information V for the same current information A. FIG. 12(*b*) is an enlarged graph of a dotted portion of FIG. 12(*a*).

Particularly, in case of a floor surface of high adhesion, an average current value may be high relatively despite a floor surface of a second type. On the other hand, in case of a carpet such as Plush of a smooth type, an average current value may be low relatively despite a floor surface of a first type. The vacuum cleaner 1 according to the embodiments may determine a type of a floor surface more accurately by considering a voltage value of the battery 300 together although the current flowing through the nozzle motor 102 is same.

FIG. 12 discloses an embodiment as follows. First of all, although a current value is obtained as 0.7 A identically, if a voltage value is equal to or higher than 26 V r, a floor surface is determined as a first type. If the voltage value is lower than 26 V, a floor surface is determined as a second type. For the same current value, the AI unit S103 and the AI model according to embodiments may obtain different probability informations if different voltage values are given. Namely, by considering voltage information V in addition to current information A, it is possible to improve performance of determination pf a floor surface type at a boundary value.

Figure 13:
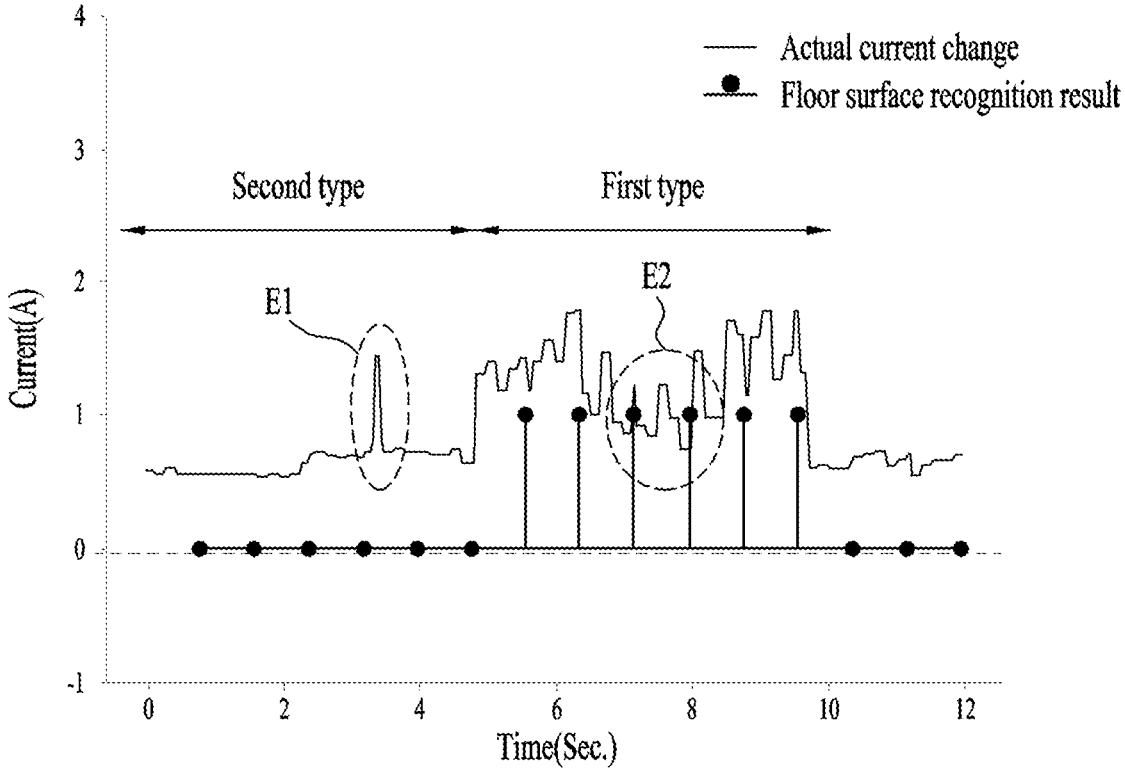
FIG. 13 is a diagram showing a test result for verifying floor surface determination performance of a vacuum cleaner according to embodiments of the present disclosure.

With reference to FIG. 13, a result for a test of floor type determination performance of the vacuum cleaner 1 according to embodiments is described as follows.

FIG. 13 is a graph showing a result from checking floor sensing performance according to each floor state by configuring a test with two kinds of floor types including a first type and a second type.

A test is performed actually in a manner of changing a cleaning area from a second type floor surface into a first type floor surface.

Additionally, in order to simulate a situation caught on an obstacle, a case that an average current value is increased more than the first type floor surface is randomly inserted for 120 ms during the cleaning on the second type floor surface, which appears in a region E1.

Moreover, a case that a current value is decreased to a level similar to a case of the second type is inserted when the first type floor surface is cleaned according to user's manipulation, which appears in a region E2.

Referring to FIG. 13, for an actual current value change denoted by a solid line, the vacuum cleaner 1 according to the embodiments stably outputs a floor surface type recognition result. When a value of the floor surface recognition result is 0, the vacuum cleaner 1 determines the floor surface as the second type. When the value is 1, the vacuum cleaner 1 determines the floor surface as the first type. As the vacuum cleaner 1 according to the embodiments has overcome the obstacle environment of the region E1 and the region E2, if the vacuum cleaner 1 is cleaning the first type floor surface, it may be observed that the value of the floor surface recognition result is returned to 0. Or, if the vacuum cleaner 1 is cleaning the second type floor surface, it may be observed that the value of the floor surface recognition result is returned to 1. This corresponds to deriving a performance result much better than the related art.

In situations that it is difficult to solve by a floor surface type determination scheme using current information A of the related art, the reliability of the floor surface sensing performance according to embodiments of the present disclosure can be substantiated.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A vacuum cleaner, comprising:

a suction motor configured to provide a suction force;

a nozzle unit having a rotating part and a dust inlet, the nozzle unit being configured to suction dust on a floor surface to be cleaned based on receiving the suction force from the suction motor;

a nozzle motor provided to the nozzle unit to transfer a drive force to the rotating part;

a nozzle shutter provided to the nozzle unit to adjust a size of the dust inlet;

a battery configured to provide power to the suction motor, the nozzle motor, and the nozzle shutter;

a model selecting unit configured to generate information on an operating state corresponding to a drive mode of the suction motor and an open/closed state of the nozzle shutter;

an artificial intelligence unit configured to generate probability information on a type of the floor surface through an artificial intelligence model using at least one of current information on a current value flowing through the nozzle motor, voltage information on a voltage value of the battery, or the information on the operating state; and a controller configured to control the drive mode based on the probability information on the type of the floor surface.

2. The vacuum cleaner of claim 1, wherein the probability information includes a first probability value indicating that the floor surface is a first type and a second probability value indicating that the floor surface is a second type.

3. The vacuum cleaner of claim 2, wherein the drive mode includes a first mode and a second mode, wherein the suction motor has a higher suction force in the first mode rather than the second mode, wherein if the first probability value is greater than the second probability value, the controller drives the suction motor in the first mode, and wherein if the first probability value is not greater than the second probability value, the controller drives the suction motor in the second mode.

4. The vacuum cleaner of claim 3, wherein the operating state comprises one of a first state that the suction motor operates in the first mode while the nozzle shutter is in the open state, a second state that the suction motor operates in the second mode while the nozzle shutter is in the open state, and a third state that the suction motor operates in the first mode while the nozzle shutter is in the closed state, wherein the artificial intelligence model includes information obtained through machine learning to determine the first probability value and the second probability value in response to the first to third states, and wherein the artificial intelligence unit obtains the first probability value and the second probability value in one of the first to third states using the artificial intelligence model.

5. The vacuum cleaner of claim 4, wherein the artificial intelligence model includes a first model machine-learned in the first state, a second model machine-learned in the second state, and a third model machine-learned in the third state and wherein the artificial intelligence unit obtains the first probability value and the second probability value in a manner of using the first model when the operating state is the first state, using the second model when the operating state is the second state, and using the third model when the operating state is the third state.

6. The vacuum cleaner of claim 2, wherein the artificial intelligence model includes a learning model for the first probability value and the second probability value corresponding to a combination of the voltage information and the current information and wherein the artificial intelligence unit generates the first probability value and the second probability value corresponding to the current information and the voltage information through the learning model.

7. The vacuum cleaner of claim 1, further comprising a pre-processing unit generating the current information by processing the current value flowing through the nozzle motor.

8. The vacuum cleaner of claim 7, wherein the pre-processing unit generates the current information by calculating an arithmetic mean of the current value measured with a configured time length and a configured time interval.

9. The vacuum cleaner of claim 1, wherein the artificial intelligence unit is configured to generate the probability information on the type of the floor surface using the current information on the current value flowing through the nozzle motor.

10. The vacuum cleaner of claim 1, wherein the artificial intelligence unit is configured to generate the probability information on the type of the floor surface using the voltage information on the voltage value of the battery.

11. The vacuum cleaner of claim 1, wherein the artificial intelligence unit is configured to generate the probability information on the type of the floor surface using the information on the operating state.

12. A method of controlling a vacuum cleaner, the method comprising:

a first step of generating information on an operating state by receiving a drive mode of a suction motor and an open/closed state of a nozzle shutter;

a second step of generating current information by receiving a current value flowing through a nozzle motor;

a third step of generating voltage information by receiving a voltage value of a battery;

a fourth step of generating probability information through an artificial intelligence model using at least one of the operating state, the current information and the voltage information; and a fifth step of controlling the drive mode of the suction motor in response to the probability information.

13. The method of claim 12, wherein the probability information includes a first probability value indicating that a floor surface currently cleaned is a first type and a second probability value indicating that the floor surface is a second type.

14. The method of claim 13, wherein the drive mode includes a first mode and a second mode, wherein the suction motor has a higher suction force in the first mode rather than the second mode, wherein if the first probability value is greater than the second probability value, the fifth step drives the suction motor in the first mode, and wherein if the first probability value is not greater than the second probability value, the fifth step drives the suction motor in the second mode.

15. The method of claim 14, wherein the operating state comprises one of a first state that the suction motor operates in the first mode while the nozzle shutter is in the open state, a second state that the suction motor operates in the second mode while the nozzle shutter is in the open state, and a third state that the suction motor operates in the first mode while the nozzle shutter is in the closed state, wherein the artificial intelligence model includes information obtained through machine learning to determine the first probability value and the second probability value in response to the first to third states, and wherein the fourth step obtains the first probability value and the second probability value in one of the first to third states using the artificial intelligence model.

16. The method of claim 15, wherein the artificial intelligence model includes a first model machine-learned in the first state, a second model machine-learned in the second state, and a third model machine-learned in the third state and wherein the fourth step obtains the first probability value and the second probability value in a manner of using the first model when the operating state is the first state, using the second model when the operating state is the second state, and using the third model when the operating state is the third state.

17. The method of claim 13, wherein the artificial intelligence model includes a learning model including the first probability value and the second probability value corresponding to a combination of the voltage information and the current information and wherein the fourth step generates the probability information by finding the first probability value and the second probability value corresponding to the current information and the voltage information from the learning model.

18. The method of claim 12, wherein the second step generates the current information by calculating an arithmetic mean of the current value measured with a configured time length and a configured time interval.

* * * * *